United States Patent [19]

Lawrence

[11] 4,343,463

[45] Aug. 10, 1982

[54] COMPACT SORTER

[75] Inventor: Frederick J. Lawrence, Tustin, Calif.

[73] Assignee: Gradco/Dendoki, Inc., Santa Ana, Calif.

[21] Appl. No.: 98,191

[22] Filed: Nov. 27, 1979

[51] Int. Cl.[3] ..... B65H 39/11

[52] U.S. Cl. ..... 271/293; 271/294

[58] Field of Search ..... 271/293, 294, 292, 295, 271/287, 288, 219; 270/58

[56] References Cited

U.S. PATENT DOCUMENTS

| | | | |
|---|---|---|---|
| 3,721,435 | 3/1973 | Zanders | 271/293 |
| 3,788,640 | 1/1974 | Stemmle | 271/293 |
| 4,203,587 | 5/1980 | Kishi et al. | 271/293 |

OTHER PUBLICATIONS

Clarkson, S. et al., "Sheet Sorter", *Xerox Disc. Journal,* vol. 1, No. 4, Apr. 1976, p. 59.

Wing, W., "Sheet Receiving Tray", *IBM Tech. Disc. Bull.,* vol. 17, No. 4, Sep. 1974, p. 1135.

*Primary Examiner*—Bruce H. Stoner, Jr.

*Attorney, Agent, or Firm*—Newton H. Lee, Jr.

[57] ABSTRACT

A sorting machine is provided to receive successive sheets from an outlet from a copying machine. The sorting machine has plural trays mounted to move progressively past the sheet outlet in opposite directions, the trays being relatively close together when positioned at either side of the outlet, but adjacent trays being widely spaced to accommodate the incoming sheets from the outlet. The trays are fed past and spaced at the outlet by driven members at opposite sides of the tray which engage and shift stacked tray supports in succession.

17 Claims, 13 Drawing Figures

(NON - SORT POSITION)

(START SORTING)

(MID SORTING)

(BOTTOM SORTING)

B
20
25
26
27
3
5
28
NS
45
43
38
37
146
M
30
11
31
18
14
41
49
100
46

COMPACT SORTER

BACKGROUND OF THE INVENTION

Over the years, as copying machines have been more widely used to produce multiple sets of copies of multiple page documents, sorting machines have been devised to accommodate the copy sheets and sort them into collated sets as they leave the copy machine.

Efforts have been made to accommodate larger numbers of sets and to reduce the space occupied by the sorter, by shifting trays to facilitate the distribution of the sheets, as shown and described, for example in U.S. Pat. Nos. 3,774,902, 3,788,640 and 4,055,339, as well as in my prior U.S. patents.

Some of the prior devices while adapting the sorter to receive a large number of sets or a large number of sheets per set have been adapted by a sheet transport to transfer sheets from the copying machine to a given tray or bin location, at which the sheet is deflected into the bin. As disclosed in my U.S. patent application Serial No. 936,724, filed Aug. 25, 1978, now U.S. Pat. No. 4,235,435 space can also be effectively saved by nesting the sheet deflectors and extending their length.

Nevertheless, there has remained a need in the industry for a small, simple and compact sorter which can be applied to copiers, as original equipment, or as a later attachment, to receive copy sheets from the outlet of the copy machine and sort the sheets into a number of collated sets, without requiring special transport means to carry the sheets from the outlet to the sorting trays or bins, and without occupying a large space for the sorting apparatus.

SUMMARY OF THE INVENTION

It is, therefore, a principal object of the present invention to provide new sorting apparatus which is improved to provide the existing need for a small or compact sorter.

More particularly, it is an object of the invention to provide moving bin or tray sorting apparatus which is simple and reliable.

Another object is to provide a sorting structure and a mount for supporting the sorting structure on a copying machine in a manner whereby the sheet discharge transport of the copying machine feeds the sheets into the sorter.

The present invention, in accomplishing these objectives, provides a shifting bin or tray sorting apparatus which can be readily applied to existing sorting machines, or to new sorting machines, to provide a copy-sorter system, wherein the sorting function or shifting of the bins is controlled by the sequential entry of a selected number of sheets into the successive bins or trays.

The bins or trays are adapted to be shifted, progressively in opposite directions, past the sheet outlet from the copier and to receive copies of successive originals while shifting in opposite directions, to minimize delay in the flow of copies to the sorter.

Shifting of the bins in opposite directions is accomplished by novel, simple transfer means, whereby the bins are moved from a first, compact or closely spaced relation, at one side of the sheet outlet from the copier to a second, compact or closely spaced relation, at the other side of the sheet outlet from the sorter, while adjacent trays are widely spaced to accommodate sheet entry as the trays are intermittently stopped to receive a sheet.

The transfer or bin shifting means includes a pair of feed elements rotatably mounted adjacent each side of the bins or trays and adapted to engage trunnions at opposite sides of the bins in a successive manner to move them between the first and second closely spaced relations. The preferred form shown herein includes cams simultaneously driven and halted, to provide the wide opening for a sheet, by a motor controlled by the passage of the sheets into the bins. At least the sheet inlet ends of the bins or trays are supported on trunnions which stack in abutting engagement. The trunnions are successively shifted by a rotary cam past the sheet inlet position, to engage the trunnions of an adjacent tray and move the previously shifted tray or trays in closely spaced condition. The trays receive sheets while being shifted in opposite directions. While the feed cams shown are in the form of helical grooves in a rotary body, other transfer means may be employed which operate to successively engage and shift the trays. With the trays spring loaded in opposite directions, the helical cam structure or screws shown herein have been found to be very efficient.

The invention contemplates providing a simple adaptor or support plate mountable on a copier and having a slot to receive a sheet from the sorter outlet and a mount for the sorting apparatus. The sorting apparatus can be self-contained and need not be electrically connected to the copier. However, the compact sorting structure can also be made in such a manner that it is an integral part of a copy-sort system, wherein the copying and sorting controls are interlocked in the usual manner.

This invention possesses many other advantages and has other purposes which may be made more clearly apparent from a consideration of the forms in which it may be embodied. The preferred form is shown in the drawings accompanying and forming part of the present application. It will now be described in detail, for the purpose of illustrating the general principals of the invention; but it is to be understood that such detailed description is not to be taken in a limiting sense.

DESCRIPTION OF THE PREFERRED EMBODIMENT

Figure 1:
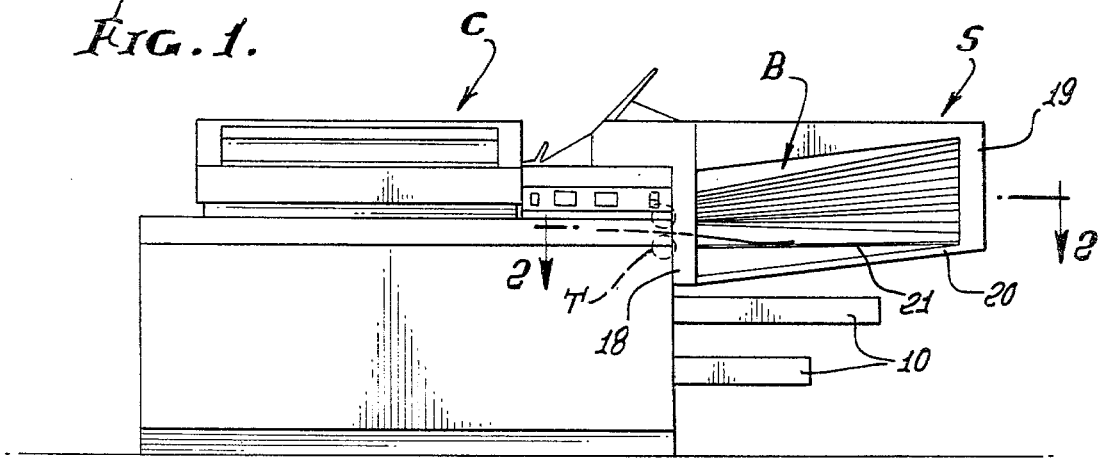
FIG. 1 is a front elevation of a copying machine with a sorter applied thereto in accordance with the invention.

As seen in the drawings, a copy machine C has a sorter S applied thereto, whereby original sheets may be successively fed to the copier and a plurality of copies are sorted into collated sets. Such copy machines are well known and are of the so-called plain paper copier type wherein the original is reproduced by the process of xerography or electrostatography.

It is not necessary to an understanding of the inventions to disclose the specifics of the copying apparatus and process, since these are well known in the art. Schematic illustration of such copying apparatus and a description of its operation are found, for example, in U.S. Pat. No. 3,990,695.

In use, original material to be copied is supplied to the copier for reproduction of a selected number of copies which are transported to the sorter by transport rollers or other known transport means T incorporated in the copier. As is also well known, blank sheets are supplied to the copier from one or more supply cassettes 10, and are transported through the electrostatic or xerographic copying apparatus.

The sorter of the present invention is operable to receive, in a non-sort mode, a number of copies of a single sheet, or, in a sort mode, to receive and collate sets of copies of plural originals supplied to the copier in succession. In the illustrated sorter provision is made for collating ten sets of copies, but it will be understood that the principals of the invention may be employed in sorters capable of collating more or less than ten sets.

The copier C shown herein is a conventional copier which may be obtained without a sorter, in which case, the copies are supplied from the transport T to the usual receiver tray. The same copier may be obtained with a sorter affixed to collate copies as disclosed in my pending U.S. Patent Application Ser. No. 936,724, now U.S. Pat. No. 4,235,435.

The present invention enables the copier C to be retrofitted with the sorter S or to be originally equipped with the sorter in a simple manner, requiring no additional transport of sheets other than the outlet transport T of the copier.

For purposes of attachment of the sorter to the copier, I provide an adaptor or plate 11 which is suitably affixed to the frame structure 12 of the copier, as by screws 13. The sorter has a frame or housing structure 14 complemental with the adaptor or plate. Connector means, shown as pins 16 on the sorter housing and slots 17 in the plate 11, are provided to enable the sorter to be easily applied to the copier and removed therefrom.

The sorter housing 14 is an elongated structure adapted to contain between an inner wall 18 adjacent the copier, and an outer end wall 19, remote from the copier, an array of trays or bins B of elongated form, which extend horizontally or lengthwise of the housing 14 for reception of copy sheets. Housing 14 is open at at least one side 20 to afford manual access to copies or sheets in the housing and may be open at both sides, either for access or ventilation. Below the lowermost bin or tray B is a plate 21 on to which copies or sheets are fed when the apparatus is in a non-sort mode in which, in the form shown, the trays are in an upper position, above the sheet inlet.

Figure 3:
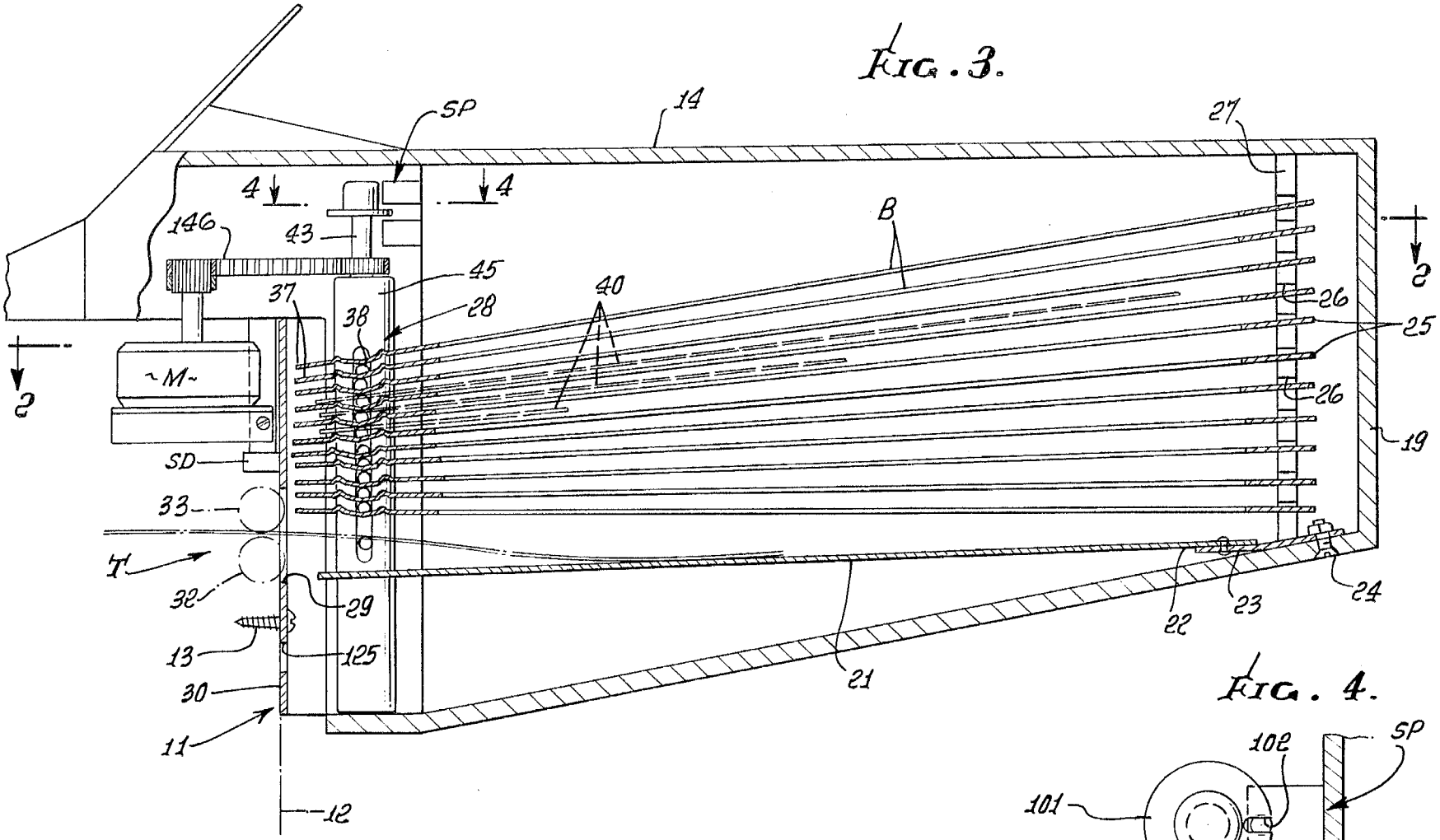
FIG. 3 is a vertical section on the line 3—3 of FIG. 2.
Figure 4:
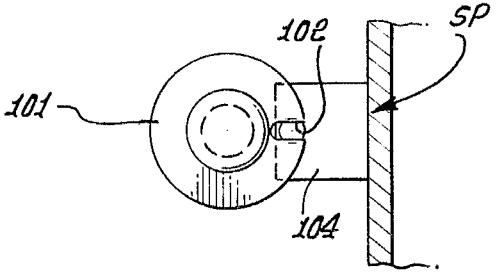
FIG. 4 is an enlarged horizontal section on the line 4—4 of FIG. 3.

Plate 21, at its outer end 22 is pivotally mounted on the housing by a flat spring 23 so as to normally assume a generally horizontal position, as seen in FIG. 3. Spring 23 may be rivetted to plate 21 and fastened to the housing by screws 24, during assembly. During operation, air discharging from the copier, exits through vents 125 in adaptor 11, below the normal position of the plate 22 and the plate deflects the air stream away from the path of the sheets during use of the copier to make multiple copies with the sorter in a non-sort mode as the sheets are transferred from the transport rolls T onto the plate 21. The spring 23, permits pivotal movement of the plate 22 downwardly, as will be later described.

In the preferred form, the sorting trays B are pivotally mounted at their outer ends 25 by slidably extending through notches 26 in ribs 27 disposed vertically in the housing, whereby at the inner ends, the trays B can be vertically shifted by shifting means 28, later to be described, past or relative to the sheet inlet opening 29 provided by the plate 11, through which sheets are fed by the transport means T of the copier.

Figure 12:
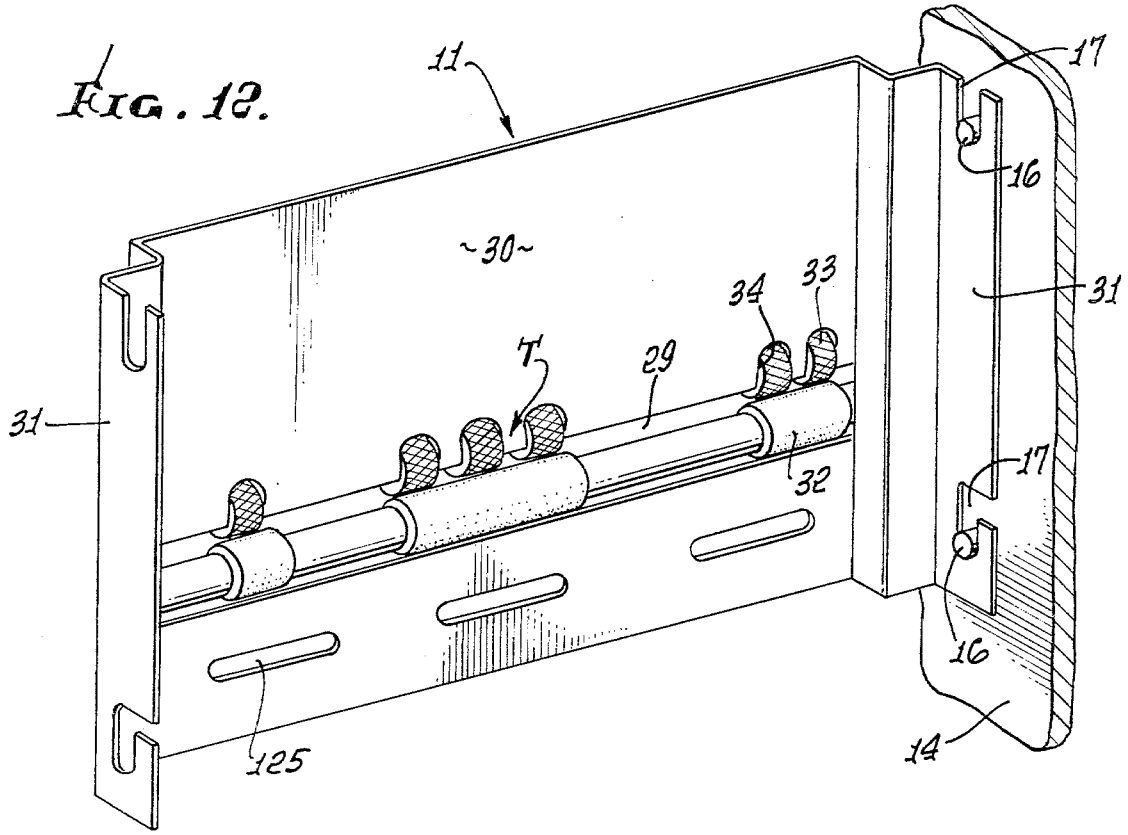
FIG. 12 is a perspective, with parts broken away illustrating the mounting plate applicable to the copying machine for supporting the sorter.

In FIGS. 1 and 3, the transport means T are shown schematically as rollers, but belts may be employed. In FIG. 12, an adaptor plate 11 is shown specifically in a form for use with the roller type transport of a particular copying machine. As shown the plate 11 is formed with a wall 30 having the sheet opening 29 therein. The wall 30 is offset from the sorter mounting flanges 31, at opposite sides of the plate, so as to be disposed on a plane at which a number of rubber or friction drive rollers 32 and a number of knurled pressure rollers 33 have chordal sections projecting through the slot 29 and vertical notches 34 in the wall 30. Thus, the sheets are fed directly, between rollers of the copier to the sorter, without requiring a special input feed, and, as will be apparent hereinafter, without requiring that the sheets be cast or projected from the transport into the sorter.

The bin or tray shifting means 28 can be best understood upon reference to FIGS. 2 through 6, wherein it will be seen that the inner ends of the trays are disposed adjacent to the adaptor plate 11 to receive paper sheets from the transport T of the copying machine. Spaced inwardly from the tray ends 37, each tray or bin B has a pair of trunnions 38 located on opposite sides of the tray and extending laterally outwardly. The trunnions are preferably formed as rolled portion of the trays, if the trays are of sheet metal, but may be molded or plastic trays. The diameter of the trunnions determines the vertical spacing between the ends 37 of the trays, when they are closely spaced above or below the sheet entry slot 29 of the plate 11.

As seen in FIG. 3, regardless of the length of the sheets 40, three different lengths of which are shown in broken lines, the sheets are dropped onto the tray with their trailing ends on the end section 37 of the respective trays. Thus the spacing of the trays by the trunnions affords space for a number of sheets in a sorted set.

In other installations, where the sheets can be cast or driven into the spaces between the trays past the trunnions, the trunnions may be easily formed as transversely extended ends.

In any event, the trunnions 38 provide, at opposite sides of the trays, projections or lugs adapted to be successively engaged by driven members 41 and shifted vertically from one side of the sheet entry location or slot 29 and to be halted to provide a wide space between adjacent trays for receiving a sheet from the transport T.

Figures 2, 7:
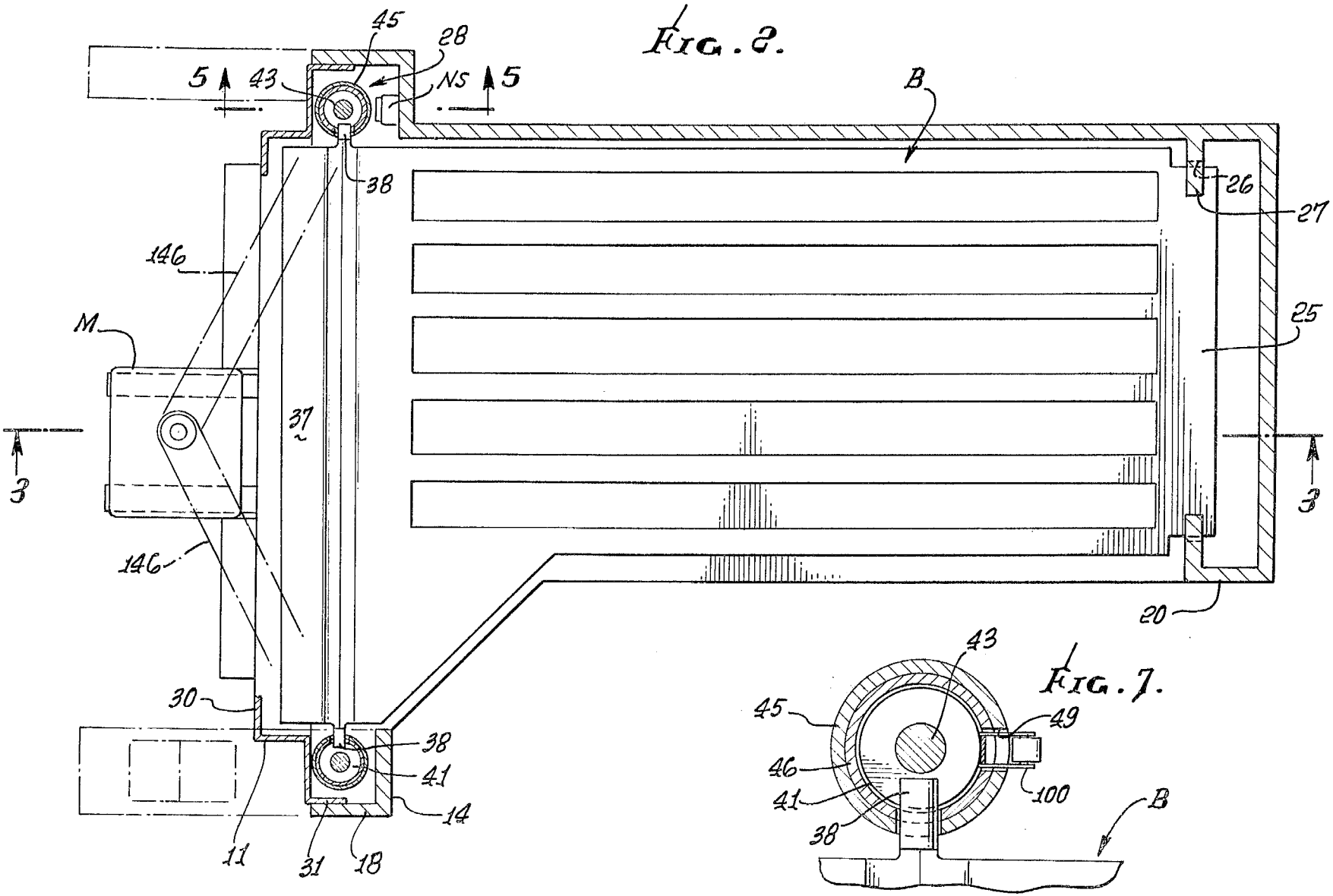
FIG. 2 is an enlarged horizontal section on the line 2—2 of FIGS. 1 and 3.
FIG. 7 is a transverse section on the line 7—7 of FIG. 6.

In this form, the driven members 41 are helically extended cams or screws having a cam track 42 into which the lugs 38 extend and function as cam followers. Each cam 41 is mounted on a rotary shaft 43 mounted in upper and lower bearings 44 in support tubes 45 suitably mounted in or formed as part of the housing structure at opposite sides of the trays, as seen in FIG. 2.

The shafts 43 are adapted to be driven rotatively by a suitable motor M, mounted on plate 11, which drives timing belts, under the control of a system to be later described.

Vertically shiftably disposed within each support tube 45 is a guide and loading tube 46 having an elongated vertical slot 47 through which the trunnions extend laterally. A key 48 on the guide tube 46 projects into an elongated keyway 49 in the stationary tube 45 to maintain alignment of the opposed slots 47 of the loading or guide tubes 46 of the bin shifters at opposite sides of the tray.

Spring means 50 are provided to load the trunnions vertically into engagement with one another and into the cam tracks 42. This spring means also supports the weight of the trays and the paper sheets thereon, during sorting operations.

Figure 6:
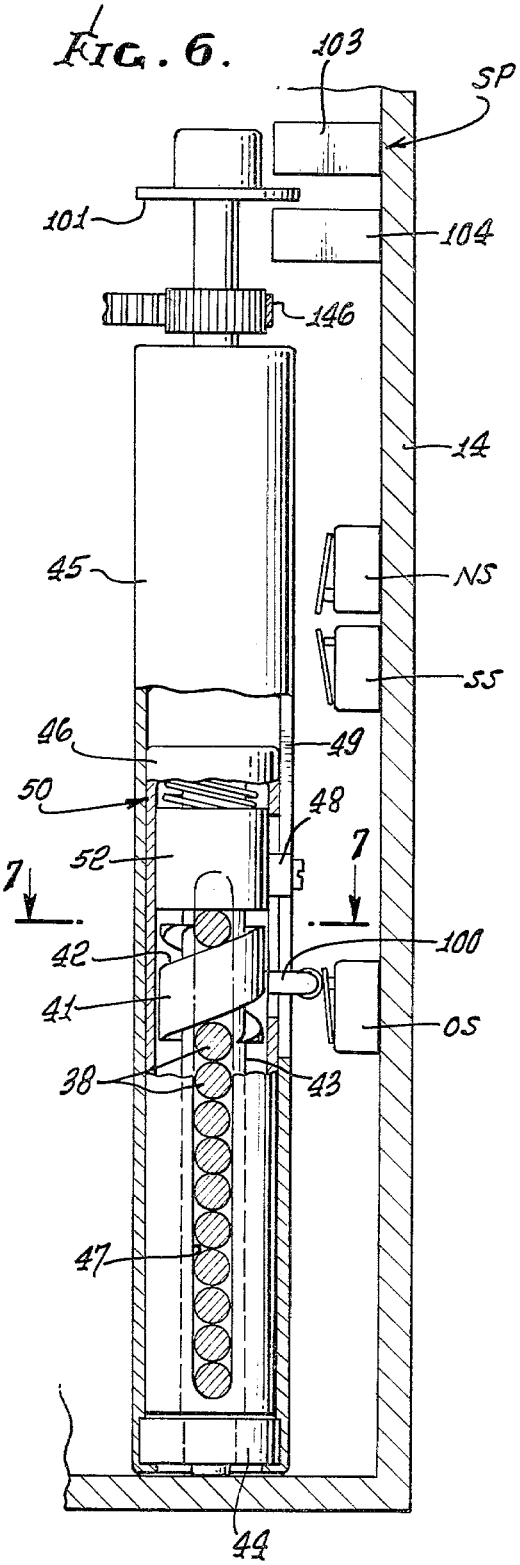
FIG. 6 is a view corresponding with FIG. 5, but showing the trays shifted to their lower position.

The spring means includes a compression spring 51 disposed between a lower spring seat 52 and an upper spring seat 53 in the tube 46, whereby to maintain a compression spring force on all of the trunnions 38, between the lower end of the lower spring seat 52 and the lower end of the slot 47 of tube 46, as best illustrated in FIG. 6. Various other spring arrangements may be employed that the trunnions 38 are always forced towards the driven transfer member 41 for engagement in the transfer recess 42. This assures that each signal to the motor M, as later described, will result in the transfer of one tray upwardly or downwardly, during sheet sorting, or that the trays will be continuously transferred from a final position to a starting position to enable sorting operations to be initiated or non-sorting operation of the apparatus.

Before describing the present control system, reference to FIGS. 8 through 11 may be helpful to an understanding of the sequence of operations. In FIGS. 8 through 11, the arrow indicates the direction and location 29 of sheet feed to the sorter apparatus.

Figure 8:
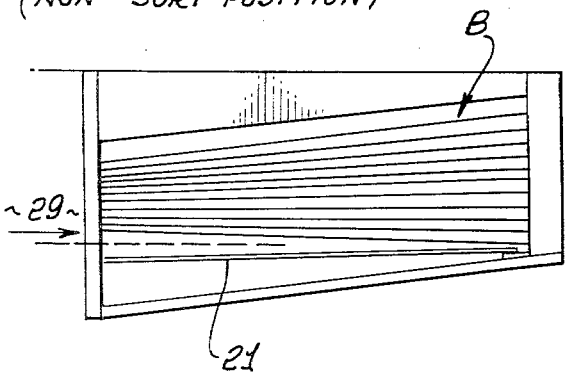
FIGS. 8 through 11 are schematic views illustrating the various tray positions indicated by the legends.

As seen in FIG. 8, the trays or bin B are all in an upper "non-sort" position (corresponding with the positions of FIGS. 3 and 5), at which a number of sheets (shown in broken lines) can be fed from the sheet inlet 29 onto the tray 21. If any substantial number of sheets are supplied to tray 21, it will move downwardly to accommodate additional sheets. The non-sort position as shown is preferred in the form of the invention shown, but the non-sort position may be reversed, so that all trays are below location 29, at the commencement of sorting and in the non-sort mode.

Figure 9:
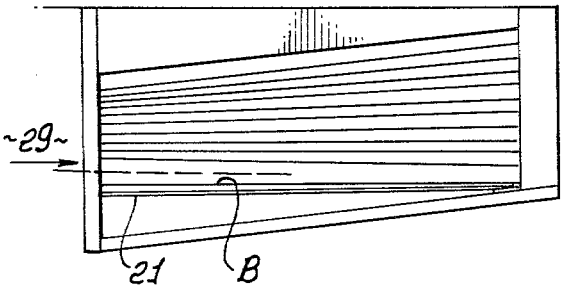

As seen in FIG. 9, the apparatus is in a "START SORTING" position, in which the lowermost tray or bin B has been shifted downwardly to a position below the entry location 29, to provide a widely spaced gap between it and the next upper tray, for receiving a sheet.

Figure 10:
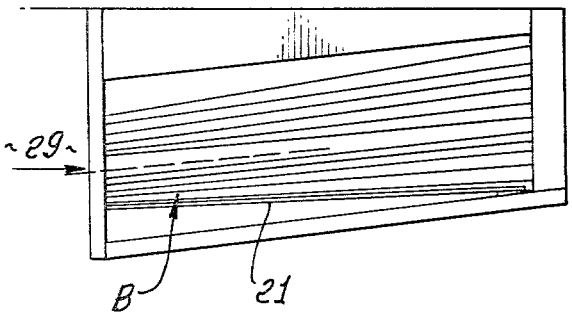
Figure 11:
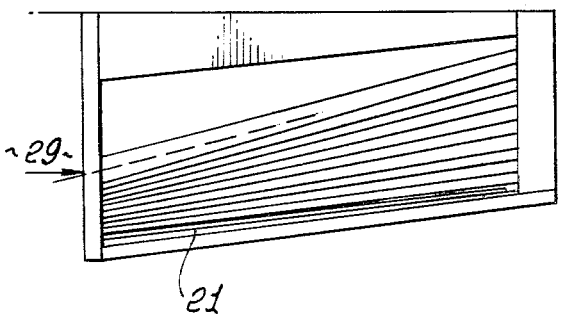

In FIG. 10, the trays have been moved successively downwardly to what may be called "MID-SORTING" position, after five copies have been fed onto the lower five trays. If more copies than five are to be sorted, up to ten in illustrated embodiment, the operation will continue until the trays are in the "BOTTOM SORTING" position of FIG. 11.

However, if a number fewer than ten are to be sorted, say the five sheets as in FIG. 10, the tray shifting means is reversed following receipt of five copies, and the lower five trays return to the position of FIG. 9, and so on until the total number of originals fed to the copier are reproduced and sorted into the illustrative five sets.

Activation of the trays to the above referred to various positions is controlled by means which causes activation of motor M to turn the respective bin shifting members 41 through one revolution in the necessary direction, whereby the trays are lowered or elevated one by one, and sheets are fed by transport T while the motor is idle and the trays are widely spaced.

These functions are controlled by a number of switching devices in circuit with the motor and certain logic means.

Figure 5:
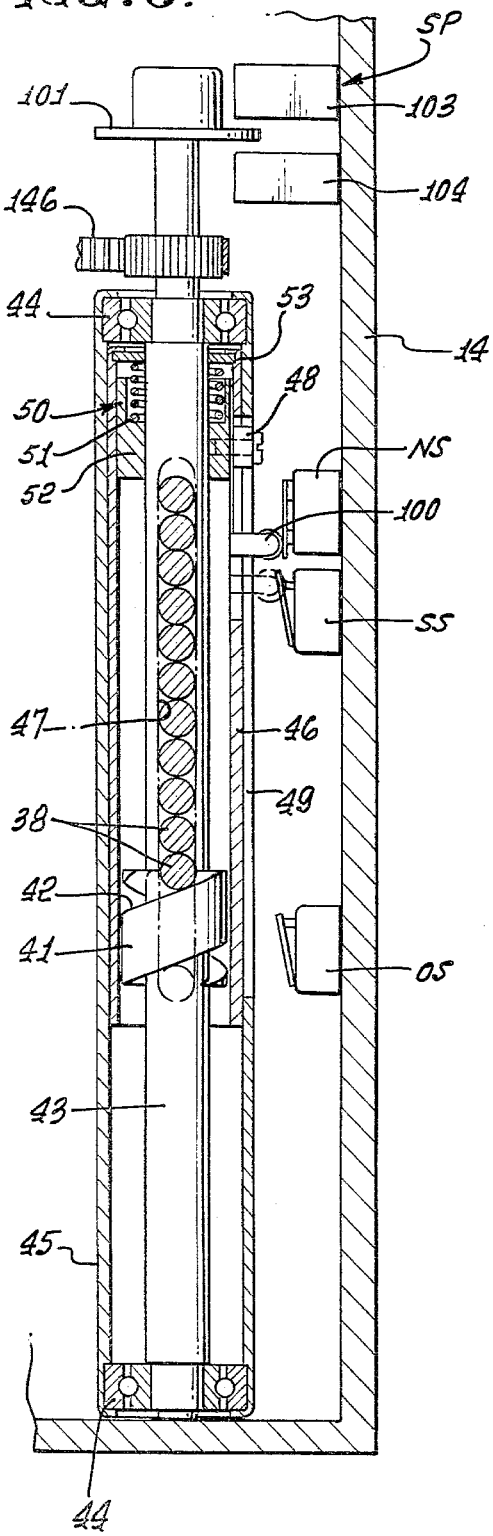
FIG. 5 is an enlarged vertical section on the line 5—5 of FIG. 2, with the trays in their upper position.

Referring to FIGS. 5 and 6, the slide seat 52 will be seen to carry a switch actuator arm 100, adapted at various vertical positions to control the motor by coaction with three vertically spaced switches of any desired type. These switches include an upper non-sort switch NS, a start sort switch SS, slightly below the switch NS, and a lower, override or reverse switch OS. Spring 50 normally biases lower seat 52 downwardly, but allows upward travel of the seat 52 to actuate switch NS, as seen in FIG. 5. In addition, a shaft position switch SP, in the form of a light sensing device, or other position responsive switch, has a disc 101 on the shaft 43 for the bin shifter 41, having a gap 102 (FIG. 4) through which light passes, on each revolution of the shift between a light source 103 and a sensor 104. A sheet detecting switch SD (FIG. 3) is associated with the transport T of the copier, to react to the passage of the trailing edge of a sheet from the copier transport T. As will later be described, the system, obviously, would include sort and non-sort selector switches and an on-off switch suitably located on the apparatus.

Figure 13:
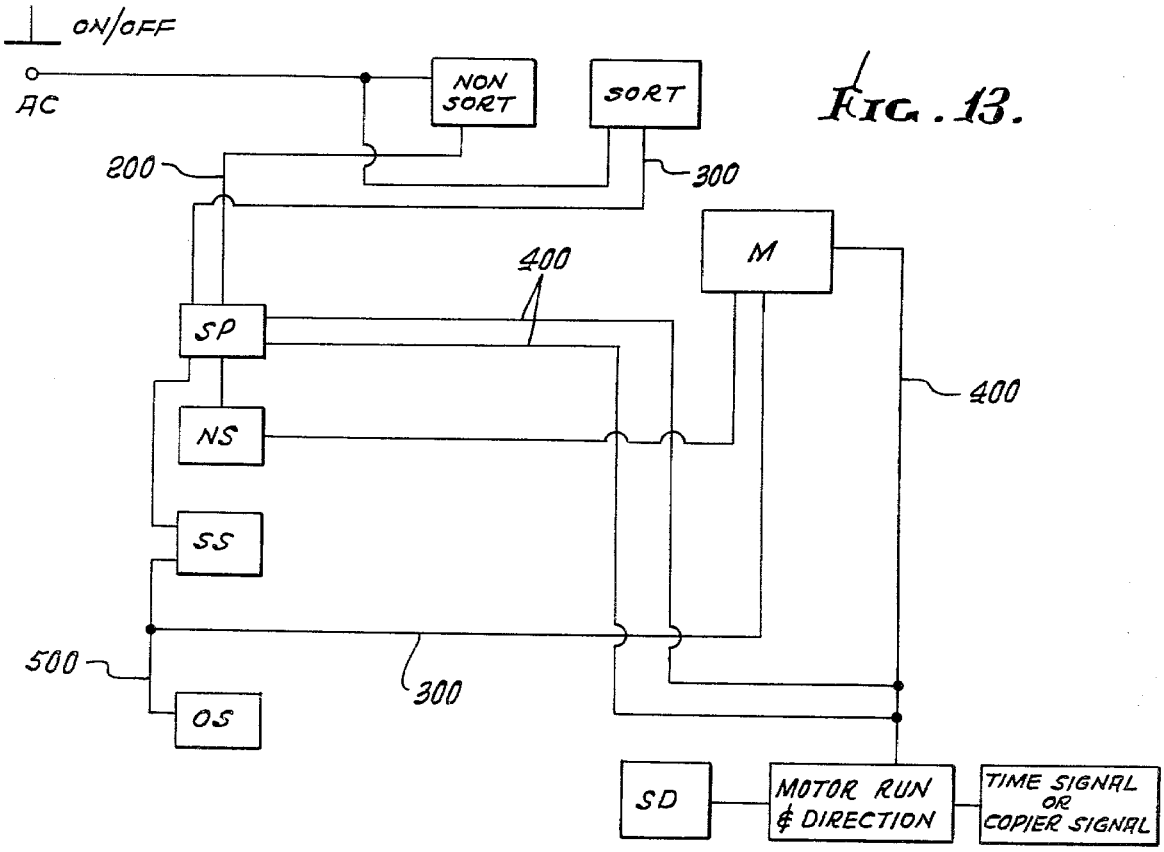
FIG. 13 is a schematic illustration of a functional control system.

A diagram of the switching and logic circuiting is generally shown in FIG. 13. An on-off switch is adapted to energize the system under the control of NON-SORT and SORT switches. The NON-SORT switch may be automatically closed when the copier is turned on, but when closed the motor M is connected with an AC source through a circuit 200 to the shaft position switch SP and the non-sort switch NS, causing the motor to be driven continuously in a direction to move all bins upwardly until the non-sort switch NS is contacted by arm 100 to stop the motor when the shaft is in the position of FIG. 5, as determined by shaft positions sensor switch SP, and shifter 42 is in position to engage the trunnion 38 of the lowermost bin, shown in full lines.

At this time, if sorting is desired, the SORT switch is closed to connect the AC source through circuit 300 with the shaft position switch SP the sort switch SS and the motor M. It will also now be noted that the motor M is also in a circuit 400 which is connected with the shaft position detector switch SP, a "MOTOR RUN & DIRECTION" logic device and the sheet detector switch SD. Activation of the system for sorting will cause one revolution of the bin feeders to shift the lowermost trunnions 38 downwardly, as shown in broken lines in FIG. 5, thereby opening the lowermost bin to receive the first copy. Additional logic is also utilized in combination with the sheet detector switch SD to time the successive activations of the motor M and direction controller in response to a time delay, or if integrated with the copier control logic a signal from the copier. For example, the time delay may be the simple time lapse between the operations of the copier to produce first copies of successive originals, as they are fed to the copier. This reverses the direction in which the motor runs, to reverse the movement of the bins from below the sheet inlet to above the sheet inlet.

The over-ride switch OS is in a parallel circuit 500 with the sort switch SS and will be activated after ten copies, in the ten bin sorter shown, have passed into the bins and the switch arm 100 on sleeve 52 has moved downwardly to a position (FIG. 6) at which the uppermost bin has its trunnions in position to be moved upwardly. The switch OS, thus, can be an automatic shut-off switch if the copier has been set to make a number of sorted copies in excess of the bin capacity.

From the foregoing, it will be apparent that the present invention provides a unique, compact sorter apparatus which can be applied to the conventional copier and which can sort a number of copy sets in an effective manner, by reason of the manner in which the bins are shifted between compact positions above and below the sheet entry location and are widely spaced at the entry location.

I claim:

1. An improved sorting apparatus of the shiftable bin type including a frame structure having means for mounting the sorting apparatus at the sheet outlet from a copying machine, sorting bins shiftable relative to one another to provide a wide sheet entry between bins at said outlet, and means for shifting the bins, the improvement wherein said bins have ends remote from said outlet pivotally arranged and ends adjacent said outlet mounted for shifting movement past said outlet, and said means for shifting said bins engages successive bins at said ends adjacent to said outlet to move the latter successively from one side of said outlet to the other, spring means acting on said bins to bias said bins in at least one direction into engagement with said shifting means, and including control means to intermittently effect operation of said shifting means in opposite directions following passage of sheets into successive bins from the copying machine, means guiding said bins at said ends adjacent to said outlet for uniform movement past said outlet including portions of said bins engaged with one another to space said bins at opposite sides of said outlet.

2. Improved sorting apparatus as defined in claim 1; said shifting means including rotary members engageable with successive bins and operative to effect longitudinal movement of said bins during shifting of said bins past said outlet, said remote ends of said bins being longitudinally shiftable during pivoting thereof.

3. Improved sorting apparatus as defined in claim 1, said shifting means including rotary members engageable with successive bins and operative to effect longitudinal movement of said bins during shifting of said bins past said outlet, said frame structure having means pivotally and longitudinally shiftably supporting said remote ends of said bins.

4. Improved sorting apparatus as defined in claim 1, including a tray below said bins for receiving successive sheets from said outlet when the ends of said bins adjacent said outlet are all positioned above said outlet, said control means including means for positioning all of said bins above said outlet.

5. Improved sorting apparatus as defined in claim 1, including a tray below said bins for receiving successive sheets from said outlet when the ends of said bins adjacent said outlet are all positioned above said outlet, said control means including means for positioning all of said bins above said outlet, said tray having resilient means biasing said tray upwardly towards said outlet and permitting said bins to move said tray downwardly when said bins are shifted to positions below said outlet.

6. Improved sorting apparatus as defined in claim 1; said spring means acting on said bins to bias said bins in opposite directions into engagement with said shifting means, said shifting means holding said bins engaged therewith in spaced relation to define said wide entry.

7. Improved sorting apparatus as defined in claim 1; said shifting means comprising a pair of rotary shafts one at each side of said frame structure and at opposite ends of said outlet, bin engaging members on said shaft operable to engage said bin portions and move said ends of said bins adjacent to said outlet as aforesaid, and motor means for driving said shafts rotatively and synchronously.

8. Improved sorting apparatus as defined in claim 7, said bin engaging members having recesses for receiving said portions of said bins at one side of said outlet and discharging said portions at the other side of said outlet.

9. Improved sorting apparatus as defined in claim 7, said bin engaging members having recesses for receiving said portions of said bins at one side of said outlet and discharging said portions at the other side of said outlet, and said spring means biasing said portions into engagement with said rotary members in opposite directions and into said recesses upon rotation of said rotary members.

10. Improved sorting apparatus as defined in claim 7, said bin engaging members being helical cams, said portions being trunnions engageable with said helical cams.

11. An improved sorting apparatus comprising: a frame structure; a plurality of bin members shiftably disposed in said frame structure; means for successively moving said bin members in said frame structure between first and second positions at which said bin members are at opposite sides of a sheet entry location and in closely spaced relation and for widely spacing successive bins at said entry location to receive a sheet at said entry location; said means for moving said bin members comprising supports at at least one of the opposite sides of said bin members in abutting relation with one another when said bin members are in said first and second positions; driven bin shifting means including a member engageable with successive supports to move said bins successively and oppositely from one side of said entry location to the other; and drive means to intermittently drive said bin shifting member in opposite directions.

12. An improved sorting apparatus as defined in claim 11; said bin shifting member comprising a spiral cam engageable with supports at opposite sides of said bin members to move said supports successively from engagement with the supports on the adjacent bin member at one side of said sheet entry location into engagement with the supports on the adjacent bin member at the other side of said entry location.

13. An improved sorting apparatus as defined in claim 11, said bin shifting member comprising a spiral cam engageable with supports of opposite sides of said bin members to move said supports successively from engagement with the supports on the adjacent bin member at one side of said sheet entry location into engagement with the supports on the adjacent bin member at the other side of said entry location; and including spring means biasing said supports towards said cam.

14. An improved sorting apparatus is defined in claim 11; said drive means including a reversible electric motor, and including switching means responsive to movement of all of said bin members to either said first or second positions to reverse said motor.

15. An improved sorting apparatus as defined in claim 11; said means for moving said bin members being at one end of said bin members adjacent said entry location, the other end of said bin members being longitudinally slideably and pivotally supported; said means for moving said bins causing longitudinal and pivotal movement of said bins.

16. An improved sorting apparatus as defined in claim 11, said bin shifting means being rotary members rotatable through one revolution to shift a bin member past said entry location, and including control means for said drive means responsive to movement of a paper sheet into a bin member to cause intermittent rotation of said rotary members through one revolution.

17. An improved sorting apparatus as defined in claim 11, said bin shifting means being rotary members having a recess receiving said supports upon rotation of said rotary members in opposite directions and discharging said supports following shifting of said bin.

* * * * *